US009966052B2

(12) United States Patent
Vázquez Díaz

(10) Patent No.: US 9,966,052 B2
(45) Date of Patent: May 8, 2018

(54) KEYBOARD WITH ADJUSTABLE TOUCH FOR A MUSICAL INSTRUMENT

(71) Applicant: Rodrigo Vázquez Díaz, A Coruña (ES)

(72) Inventor: Rodrigo Vázquez Díaz, A Coruña (ES)

( * ) Notice: Subject to any disclaimer, the term of this patent is extended or adjusted under 35 U.S.C. 154(b) by 0 days. days.

(21) Appl. No.: 15/118,261

(22) PCT Filed: Feb. 5, 2015

(86) PCT No.: PCT/ES2015/070076

§ 371 (c)(1),
(2) Date: Aug. 11, 2016

(87) PCT Pub. No.: WO2015/121518

PCT Pub. Date: Aug. 20, 2015

(65) Prior Publication Data

US 2017/0186412 A1 Jun. 29, 2017

Related U.S. Application Data

(60) Provisional application No. 61/938,945, filed on Feb. 12, 2014.

(51) Int. Cl.

| | |
|---|---|
| ***G10H 1/34*** | (2006.01) |
| ***G10C 3/12*** | (2006.01) |
| ***G10F 1/02*** | (2006.01) |

(52) U.S. Cl.
CPC ..... *G10H 1/346* (2013.01); *G10C 3/12* (2013.01); *G10F 1/02* (2013.01)

(58) Field of Classification Search
CPC ..... G10H 1/346; G10C 3/12; G10F 1/02
(Continued)

(56) References Cited

U.S. PATENT DOCUMENTS 2,950,642 A * 8/1960 Sluyter ..... G10C 3/12 84/236
3,680,426 A * 8/1972 Fry ..... G10C 3/12 84/433

(Continued)

FOREIGN PATENT DOCUMENTS

DE 42 23 739 A1 1/1994
DE 4223739 A1 * 1/1994 ..... G10C 3/12

(Continued)

OTHER PUBLICATIONS

International Search Report dated Jun. 25, 2015, dated Jul. 7, 2015.

(Continued)

*Primary Examiner* — David Warren
*Assistant Examiner* — Christina Schreiber
(74) *Attorney, Agent, or Firm* — Norris McLaughlin & Marcus P.A.

(57) ABSTRACT

A keyboard with adjustable touch for a musical instrument, each key being a lever divided into front and rear arms, front arm forms on its upper part an operation surface and its lower part interacts with a centering guide, and the rear arm comprises, on its upper part, a counterweight and its lower part interacts with a stop each key comprises a key magnet (KM) mounted on the rear side, facing another magnet (SM) that is mounted on a regulation device which is affixed to the musical instrument chassis, the magnets (KM and SM) are substantially placed face to face, opposed by their equivalent polar faces, the relative position they have to each other is set by the regulation device and generating the effect on the keyboard touch.

9 Claims, 7 Drawing Sheets

(58) Field of Classification Search
USPC ..... 84/745
See application file for complete search history.

(56) References Cited

U.S. PATENT DOCUMENTS

| | | | | | |
|---|---|---|---|---|---|
| 3,724,317 | A * | 4/1973 | Rogers | G10C 3/28 | 84/447 |
| 4,194,428 | A * | 3/1980 | McFarlin | G10C 3/20 | 84/236 |
| 4,524,669 | A * | 6/1985 | Yamamoto | G10C 3/12 | 84/433 |
| 4,899,631 | A * | 2/1990 | Baker | G10H 1/053 | 84/433 |
| 6,472,589 | B1 * | 10/2002 | Lee | G10F 1/02 | 84/21 |
| 6,525,257 | B1 * | 2/2003 | Hermann | G10C 3/12 | 341/32 |
| 6,930,234 | B2 * | 8/2005 | Davis | G10H 1/346 | 84/423 R |
| 7,547,833 | B2 * | 6/2009 | Yamashita | G10F 1/02 | 84/18 |
| 7,667,116 | B2 * | 2/2010 | Yamashita | G10C 3/00 | 84/20 |
| 7,915,509 | B2 * | 3/2011 | Stanwood | G10C 3/12 | 84/423 R |
| 8,138,402 | B2 * | 3/2012 | Komatsu | G10F 1/02 | 84/20 |
| 8,288,640 | B2 * | 10/2012 | Yaguchi | G10H 1/346 | 84/17 |
| 8,383,920 | B2 * | 2/2013 | Komatsu | G10C 3/20 | 84/17 |
| 2003/0183066 | A1 * | 10/2003 | Gallitzendorfer | G10H 1/0555 | 84/745 |
| 2006/0272469 | A1 * | 12/2006 | Meisel | G10F 1/02 | 84/21 |
| 2017/0186412 | A1 * | 6/2017 | V zquez d az | G10H 1/346 | |

FOREIGN PATENT DOCUMENTS

| | | | | |
|---|---|---|---|---|
| EP | 0567024 | A2 * | 4/1993 | |
| EP | 567024 | A2 * | 10/1993 | |
| EP | 312180 7 | A1 * | 1/2017 | |
| EP | 3121807 | A1 * | 1/2017 | |
| FR | 2 488 018 | A1 | 2/1982 | |
| WO | WO 0054248 | A1 * | 9/2000 | G10C 3/16 |
| WO | 01/95308 | A1 | 12/2001 | |

OTHER PUBLICATIONS

English Translation of International Search Report dated Jun. 25, 2015, dated Jul. 7, 2015.

* cited by examiner

KEYBOARD WITH ADJUSTABLE TOUCH FOR A MUSICAL INSTRUMENT

This application is a 371 application of PCT/US2015/070076 filed Feb. 5, 2015, which claims foreign priority benefit under 35 U.S.C. § 119 of U.S. Provisional application 62/938,945 filed Feb. 12, 2014.

FIELD OF THE INVENTION

This invention relates to the field of musical instruments, particularly those that are performed by means of a keyboard. More particularly, this invention relates to musical instrument keyboards of the type of electronic synthesizers.

RELATION TO THE PREVIOUS ART

Throughout history, keyboards have been adopted as elements for the interaction between a player and the musical apparatus in the case of many instruments. Organs, clavichords, harpsichords, pianos and, currently, synthesizers share the standardized distribution of black and white keys.

The keyboard of every instrument has its own dynamic characteristics that are linked to the physics of the mechanism being used such as, for example, counterweights, hammers, valves, plectrums, levers, springs and the like, and they are optimized to permit their docile performance. The tactile perception of a mechanism is ordinarily known as action or touch: for example, hammer action with escapement in pianos, key stop action, in organs, spring action, in an electronic synthesizer, and the like.

The way a performance is carried out is consistent with the physics itself of the instrument, and the keyboard touch is exactly what is expected from the sound achieved, with the exception of the electronic synthesizer, capable of mimicking any sound, but up to now it cannot mimic every touch.

This means that a piano, which is an instrument of strings stricken with hammers, has a piano touch; an organ, a wind instrument with valves, has an organ touch, and so on.

In Tobias Matthay's book *The act of touch in all its diversity* (Bosworth & Co. Ltd., London, May 1954), some important concepts regarding the desirable characteristics of a keyboard, such as the adequate weight, related to muscle capabilities of hands, are emphasized. It is also emphasized the difference between weight and friction, as it is read in the following excerpt taken from said quote: " . . . Heaviness of this kind must, moreover, not be confused with "stickiness" . . . . " " . . . The key should slip down "clean"—with the least possible amount of friction. This does not imply that the key may not be considerably weighted. Friction is impedimental, but weight is not . . . . "

A correct weight gradation is very important because it gives assurance to a musician but the adequate amount of weight is a subjective factor that depends on taste and muscle capacity of a performer's hand.

An electronic synthesizer is the only instrument capable of varying its timbre characteristics in a way such that it is possible to mimic the sound of various instruments and of every imaginable sound. And although it is a young instrument, it is being developed at overwhelming speed and depth, with respect to the development of electronics and software.

But there exists a problem: the synthesizer keyboard has not accompanied the instrument development accordingly, and this is not a irrelevant point.

The keyboard of every instrument is the man-machine interface: it is from where an artist transfers his ideas to sound, by subtly handling keyboard timbre characteristics for the creation of Art.

Because of that, the manufacturers of musical instruments invest their resources into the development of their keyboards, with the purpose of perfecting the capabilities of controlling the instrument subtly.

In the case of an electronic synthesizer there is an obvious shortcoming: the instrument may generate any sound, but the keyboard cannot generate any touch.

Manufacturers of keyboards for current synthesizers adopt a position of compromise for their keyboards touch and decide which touch their product is going to have according to a criterion based, in the best of cases, on a statistical study of musician's tastes. Moreover, there exist keyboards having different touches, based on the use a musician may need: for example, there are keyboards with light keys, keyboards with counterweighted keys or with a hammer effect or even with actual hammers, to mimic a piano dynamic response.

But this approach is too narrow for the sound possibilities of a synthesizer, that is capable of producing infinite sounds, because some sounds benefit from a heavy keyboard; others, from a fast keyboard; others, from a light keyboard and others, from a keyboard with escapement, and still others, from a keyboard without escapement and, what is more important, a musician's personal preferences and even his physique are critical for a controlled execution of an instrument played by means of keys.

Therefore, a keyboard should vary its dynamic characteristics, such as weight, elasticity, escapement and the like, to coherently adapt to the sound whose handling is being tried and to the hand of the performer who is playing it.

For a synthesizer and, furthermore, a virtual synthesizer, to be complete and reach the status of musical instrument, it must have a keyboard capable of adapting to the dynamics of the sound being generated.

All of the aforesaid cannot be prearranged at the factory: it is needed a keyboard the musician himself be able to adapt to his needs in an easy, fast and practical way. In other words: an artist must be able to create, not only a sound but a whole musical instrument.

Because of what has been said, it has been a long time now that exists the need for a keyboard whose touch and dynamics could be modified in such a way that it could emulate physical and mechanical characteristics of the diverse types of keyboard instruments, such as the weight and escapement of an conventional piano; the intermediate—weight keys and the retention at the travel start, characteristics of an organ or the elasticity of a spring with diverse tensions in an electronic synthesizer, just to mention the most important ones.

Few attempts to create a keyboard with these characteristics were made. Among the previous art background it is the American U.S. Pat. No. 3,680,426A, published on 1 Aug. 1972 granted to Earl E. Fry, titled Piano keyboard with magnetic key control: an attempt to modify an conventional piano touch by a player is described. The obvious shortcomings of this invention are the use of a spring on the fulcrum backside to counteract the effect of magnetic attraction created by the magnets located on the fulcrum front side. The system with the spring applied has an elastic touch which happens to be unacceptable for a high-performance piano. Without the spring applied, the magnet effect tends to depress the key acting in the same way the musician does but, if too much effect is applied, there exists the danger of the key being blocked by the attractive action created by the magnet. It is because of this that the problem is solved with the spring, to bring the key back to its rest position.

In the American U.S. Pat. No. 4,899,631A, published on 13 Feb. 1990 and granted to Richard P. Baker, titled Active touch keyboard, it is described an attempt of solution whereby electronically-controlled motors linked to each key by means of wires and pulleys are used. The resistance to movement can be handled by applying more or less electric energy to the motors that generate the torque needed to modify the key touch with more or less resistance to movement. The author describes it as inertia modification, but the term dampening is more adequate tan inertia, since the motor torque generates a movement resistance that is modulated by the electric current applied. Inertia is dependent on mass and cannot be modified without modifying the mass of the mechanism.

This is the most developed approach in the previous art, but still presents problems not satisfactorily solved. Motor, wire and pulley inertia influences the keyboard repetition capability, this being an attribute highly coveted by trained musicians. This approach has a high level of friction, created by the complexity of the motor, wires and pulleys system, that diminishes movement gentleness. It is a system that generates resistance to movement, that is to say, dampening: this compromises movement fineness. It is sensitive to malfunction and breakage, because it uses many components, such as pulleys, wires and motors, per key to achieve its goal. It requires a capability of electronic processing for the data generated by the motors, thus creating possible response delays. It consumes electric energy permanently, both for the motors and the electronic processors.

Another attempt to solve the same problem is described in the U.S. Pat. No. 6,930,234B2, published on 16 Aug. 2005 and granted to Lanny Davis, titled Adjustable keyboard apparatus and method. Here it is utilized a levers and hammers mechanism that, through the variation of the support point, can modify touch within a narrow range of possibilities. This system is even more basic because response curves cannot be radically modified. It has even more friction than the previous example and the keys are linked to the chassis by steel sheets acting as springs, what imparts an unacceptable degree of elasticity for a keyboard intended for high and vast performance.

Within the few methods existing in the previous art to create keyboards with specific touches, is the one taught by the application PCT of Snel, Everardus A. M. et al. published on 14 Sep. 2000 with number WO2000054248A1, titled Piano provided with a key- and hammer mechanism comprising permanent magnets, where a system using permanent magnets to balance the weight of keys that creates a magnetic balance is described.

In this document it is satisfactorily solved the problem presented by U.S. Pat. No. 3,680,426A and application WO2000054248A1, by placing another permanent magnet on the backside of the fulcrum, thus permitting to satisfactorily balance the key. Indeed, this is a mechanism devised for conventional pianos that uses two pairs of magnets on one side and the other of the fulcrum, or key's pivot point: this permits to regulate the feeling of weight of the key. It acts as a magnetic servomechanism by applying magnetic force in the same direction as the musician's. Although this latter mechanism is an improvement, it does not allow for a radical modification of touch in a keyboard and even less, to mimic all of the existing mechanism types, nor it can be easily modified by a user: in order to do this a technician is required. Besides it is restricted to the modification of the weight sensed by the pianist. In this document not only are improved the teachings of U.S. Pat. No. 3,680,426A to the same purpose, but this invention was put into practice in some pianos of the Petrof brand.

Both inventions, U.S. Pat. No. 3,680,426A and WO2000054248A1, even when they use permanent magnets, have completely different approaches with respect to the present invention. In these two cases what is sought is to counteract the force needed to move a piano mechanics. None attempts to radically modify keyboard responses and, still less, to mimic other instruments, consequently differing greatly as regards their objectives and, still more important, the way they use the magnetic fields is radically different, to wit: in the last two said inventions from the previous art, the magnetic field are located so they can apply their forces one way only, the one of pressing the key, which we will call positive for the sake of didactics only. The positive effect can be regulated in plus or minus only. The present invention adopts a radically different way and may take advantage of three effects: positive, negative and change of effect direction, that is to say, to add weight (negative effect), diminish weight (positive effect) and, most important, it allows for the regulation of the key's travel point, where the change of effect direction takes place, what generates the escapement effect. Indeed, at the travel start a negative effect—weight increase—is felt and, after the point of maximum magnetic repulsion—escapement—, the effect direction changes and the effect is felt as positive—diminution of weight. Besides, it is important to note that, with the present invention, the proportions of the diverse effects can be regulated at will and with great ease, by merely modifying the relative position between the magnetic fields of the key magnet and its corresponding set magnet.

What is sought here is to mimic the touch of every type of keyboard—conventional piano, organ, synthesizer, and every intermediate point, in a unified form in a single instrument and by a same user.

The aforementioned mechanisms are the most relevant of the previous art and all of them attempt to solve the problem of adaptability of a keyboard to the taste or needs of a musician, or to improve the dynamic capabilities of a keyboard.

It is clear that none of the mechanisms for the interaction instrument-performer can be radically modified by the user at will, in order to mimic the specific dynamics of every type of keyboard and with this take advantage of the vast current and future capabilities of synthesis software, without sacrificing the delicacy of movement a true musical instrument should have.

Therefore, there persists the need to have a keyboard mechanism for high performance, for musical instruments of the electronic synthesizer type, that can be adapted to every instrument performed through keys and that vary its dynamic characteristics according to its user's preferences.

SUMMARY OF THE INVENTION

Consequently, it is the object of this invention a keyboard with adjustable touch for a musical instrument, the said keyboard comprising a plurality of keys, each one of which is a lever seating on a pivot point substantially central that divides the lever into two arms, a front one and a rear one, where the front arm forms on its upper part an operation surface and its lower part interacts with a centering guide, and the rear arm comprises, on its upper part, a counterweight and its lower part interacts with a stop where the key sits while in its rest position, wherein each key of the keyboard comprises a key magnet (KM) mounted on the rear side, facing a set magnet (SM) that is attached to a regulation device that set the position of said set magnet (SM) in relation with the key magnet (KM), this device being affixed to the apparatus chassis, where the magnets (KM and SM) are always substantially faced by their equivalent polar faces, so these magnets repel each other, and the relative position said KM and SM have to each other generating the effect on the keyboard touch.

Preferably, one magnet (SM) is affixed to a regulation device that is affixed to the instrument chassis, while the other magnet (KM) is affixed to each key's rear side.

More preferably, the regulation device fixed to the chassis, comprises a support, where there is a series of set magnets (SM) arranged along the support, or a single set magnet (SM) constituted by a bar longitudinally mounted on said support or a plurality of supports with their respective set magnets (SM) in relation with each key magnet (KM), in all cases the SM and the KM must be with their polar faces encountered by their magnetic equivalent poles.

Accessorily, each key comprises, at least one, secondary system arranged underneath the front arm or the rear arm, or beneath both at the same time, where, at least one, secondary system comprises one pair of magnets (KM and SM) faced in opposition by their equivalent polar faces, one of them affixed to a key (KM) and the other (SM) mounted on a regulation device that is affixed to the instrument chassis.

In a preferred way, each key comprises two secondary systems, one underneath the front arm and the other underneath the rear arm.

Preferably, the key magnets (KM) and the magnets mounted on the regulation device (SM) are selected from permanent magnets, electromagnets, electro-permanent magnets and combinations thereof.

Also preferably, each key comprises a contactless position sensor selected from the group consisting of the Hall-type, optical type and capacitive type conveniently affixed according to the physical design of the keys.

More preferably, the regulation device may take a series of positions that define the configuration touch modes, through the displacement of the set magnet (SM), or magnets, mounted on said regulation device, moving away or moving closer from the magnetic fields of the key magnets (KM) from a lower position, passing through an intermediate position, to an upper position, where the lower position is below the level of highest repulsion intensity of the magnetic fields of the key magnets (KM), and the upper position is above the level of highest repulsion intensity of the magnetic fields of the key magnets (KM), and the middle position is right in the area of maximum repulsion, where the keys are in a rest position.

Even more preferably, the regulation device is positioned manually or through an electronically controlled motor.

In a preferred way, the electronically controlled motor responds to instructions generated by a PLC (acronym of Programmable Logic Controller).

BRIEF DESCRIPTION OF THE FIGURES

FIG. 3 shows the key from FIG. 1 with the set magnet (SM) affixed to the regulation device at an intermediate position in relation with the key magnet (KM).

FIG. 4 shows the key from FIG. 1 with the set magnet (SM) attached to the regulation device at a lower position in relation with the key magnet KM.

DETAILED DESCRIPTION OF THE INVENTION

Figure 1:
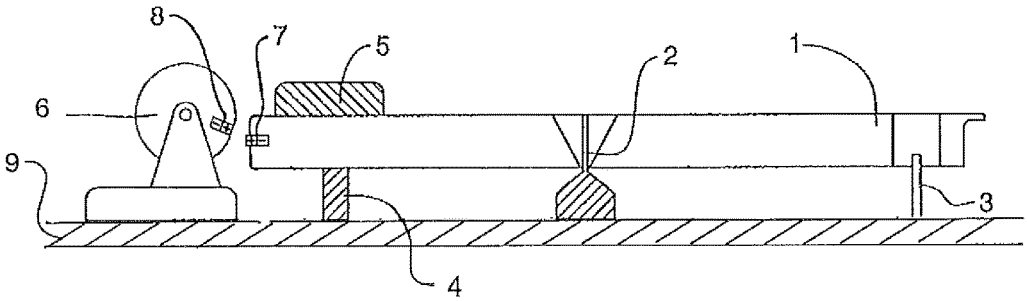
FIG. 1 shows a lateral sectional view of a preferred form of embodiment of a key for a keyboard according to the present invention, with a central pivot point and a Hall sensor.

The present invention relates, then, to the creation of a keyboard mechanism of high performance for musical instruments of the piano, organ, and the like, types and, more preferably, for electronic synthesizers, the said keyboard able to vary its dynamic characteristics according user preferences.

Weight, elasticity, escapement and travel point of the key (1) where these properties are to be applied can be adjusted in a precise way, through the interaction of magnetic fields in diverse positions and configurations.

Through the modification of the relative position between magnets (SM and KM) (7, 8), such as distance, angle or intensity of a magnetic field, or the modification of all these at the same time, the touch feeling of all the key (1)— performed instruments is emulated or a user preference, or both at the same time, are adjusted simply, rapidly and efficiently.

It also admits the possibility of programming diverse configurations in electronic memories and synchronizing them with software, by means of a motorized operation, or else operating the system manually without any expense of energy. These latter characteristics allow for its adaptation to digital keyboards, with the possibility of automation, or to conventional instruments, to generate modifications in the response curve of their keyboards or else, to use them as servomechanisms.

The two only points of friction for a key are the central balance or pivot point (2) (fulcrum) and the front centering point (3), what makes this solution to excel every other mechanism from the previous art, because key (1) weight, elasticity, escapement and travel zone can be modified, where said forces are applied without increasing the system inertia nor increasing friction, what gives it unique characteristics: a soft functioning, a very high rate of repetition and a huge configuration flexibility because, when forces are handled by means of magnetic fields, the system inertia is not increased, because inertia is directly proportional to the mass of the key (1).

Thus, as regards performance and flexibility, the systems of the previous art are vastly surpassed.

This system is extremely flexible and admits multiple configurations or touch modes.

The primary system is based on the interaction of two magnetic fields, one, a key magnet (KM) affixed to the rear side of the key (1), and the other, a set magnet (SM) attached to a regulation device (9) which, in turn, is affixed to the chassis. The regulation device has the function of setting the position of the set magnet (SM) fixed on it, and does not move during playing the keyboard.

When the KM is moved during the execution of the key through the magnetic field of the SM, which is fixed with respect to the chassis, an increase or decrease of the rejection is produced during their movement that depends on the position relative of the KM and the SM, this rejection is perceived by the musician as a variation of the resistance, as it is set the SM.

The regulation device (9) comprises a longitudinal support attached to the instrument chassis and upon the support there is mounted a series of set magnets (SM) (8) or else a single set magnet (8) constituted by a magnetic bar longitudinally mounted on said support. Alternatively, the primary system comprises a regulation device (9) individual for each key (1), said regulation device comprising its own set magnet (SM) (8) in all the cases in correspondence with the key magnets (KM) (7) mounted on the rear sides of each key (1), wherein the SM and the KM must be with their polar faces encountered by their magnetic poles equivalents, that way both magnets repels each other. The touch effect is reached when the key magnet (KM) travel across the stationary magnetic field of the set magnet (SM) during playing. Whatever may be the said configurations, they constitute the primary system.

Through the setting of the relative position between magnets (SM and KM) (7, 8), distance and angle or the intensity, or all of these at the same time, of the magnetic field, the sense of touch of all the instruments performed by keys (1) are emulated or the keyboard is adjusted to the user preferences, or both things at the same time, are done easily and rapidly.

It admits the possibility of programming diverse configurations in a digital memory and synchronize them by means of a software, to apply them to the system afterwards, through a modification of the intensity of the magnetic field of electromagnets or electro-permanent magnets or a motorized or manual operation, or both modification and operations at the same time, of the positioning of the magnets (7, 8).

With a single pair of permanent magnets (SM and KM) (7, 8) the said objective is achieved, but the performance can be improved even better by adding multiple secondary systems (10, 11) with the same principle of functioning, at several points of the key (1). The more secondary systems (10, 11) are placed on a key (1) in different positions, the more flexible the global system will be and more configuration possibilities are achieved.

In the case the keyboard is used as a MIDI controller, some MIDI velocity measurement system available in the market should be used. To that purpose the utilization, for example, of Hall-type sensors (6) is suggested, since they can take advantage of the magnets (7) affixed to the keys for position reference and they admit a great flexibility, but other systems can be used with the same outcome, provided they are contactless position measuring systems (6), such as optic, capacitive, magnetic and the like.

The keys (1) may comprise contactless position sensors (6) of any kind such as, for example, the already mentioned Hall-type sensors, as well as optic type, capacitive type, and the like, sensors (6), these being conveniently affixed to the keys (1) for the delivery of data for their external processing.

In FIG. 1 it is depicted a preferred embodiment of a key (1) according to this invention, with a Hall-type sensor (6).

The simplest system consists of two permanent magnets (SM and KM) located with their equal positive or negative poles faces facing each other in a way such that repulsion is created between them. One magnet (the KM) (7) attached to a key (1) and another magnet (the SM) (8) affixed to a regulation device (9). When the regulation device (9) modifies the position of the set magnet (SM) in relationship with the key magnet (KM), the effect desired on key (1) is achieved because of the magnetic interaction between both magnets (7, 8).

The regulation device is designed to set the position of the set magnet (SM) in relationship with the key magnet may (KM) and take a series of positions that define the configuration touch modes, through the displacement of the (SM) magnet, or magnets, mounted on said regulation device, moving away or moving closer from the magnetic fields of the key magnet (KM) from a lower position, passing through an intermediate position, to an upper position, where the lower position is below the level of highest repulsion intensity of the magnetic fields of the key magnet (KM), and the upper position is above the level of highest repulsion intensity of the magnetic fields of the key magnet (KM), being the middle position right in the area of maximum repulsion where the keys are in a rest position. Note that the regulation device and the set magnets (SM) do not move during playing the keyboard. Set magnet (SM) must remain static, while key magnet (KM) travel through its field.

Therefore, there are three basic configuration touch modes. MODE 1: Touch of spring, (FIGS. 2*a* and 2*b*), the point of maximum repulsion is located at the end of the KM travel. In this case the force required to move the key gradually increase from the beginning of the travel to be maximum at the end of the travel, as does a spring loaded like electric organ or synthesizer. MODE 2: Escapement piano like touch, (FIG. 3*a*, 3*b*, 3*c*), the point of maximum repulsion between KM and SM is just half of the KM travel. In this case, the force required to move the key is increased from rest position to be maximum at the middle position of the travel, where the point of maximum resistance is located. And when it is exceeded this point, frees the resistance to motion of the key and generates a small step perceived by the musician, thus mimicking the moment of escapement of a piano is perceived. MODE 3: Touch of organ or light keys. (FIGS. 4*a* and 4*b*), the point of maximum repulsion between KM and SM is located at the beginning of the KM travel. The point of maximum repulsion is located at the beginning of the KM travel, the effect is counteracting the weight of the key and makes it more lightweights. Note that the set magnet (SM) and his associated regulation device do not move during playing the keyboard, just move when set the mode of touch.

Using electromagnets or, even, electro-permanent magnets, a still greater system flexibility is achieved, because it is possible to modify the magnetic field intensity and polarity, this allowing for the modification of the characteristics of touch by individual keys (1) or to split the keyboard for diverse effects or to increase the weight on the bass keys (1) of the keyboard to mimic, for example, the graduation effect of hammer weights in an conventional piano.

By multiplying this system into secondary systems using the same functioning principle, the configuration possibilities are increased even more.

In FIG. 1 a lateral view of a key (1) according to this invention, with a central pivot point (2) is depicted.

On the end opposed to the zone where a user presses a key (1) there is a group of two permanent magnets (KM and SM) faced by there polar faces (7, 8), placed in such a way they polar faces repel each other. A fixed magnet (7) is mounted on the rear face of a key magnet (KM) and another magnet (the SM) (8) is affixed to a regulation device (9), mounted on the apparatus chassis. The regulation device (9) set the position of the set magnet (SM) (8) in relationship with the key magnet (KM) (7) allowing the different touch modes of configuration above described.

This generates a repulsion effect that makes the modification of the set magnet (SM) (8) position affixed to the regulation device (9) to create an effect upon the force needed to move the key (1).

By means of the modification of the position of the set magnet (SM) (8) affixed to the regulation device (9), the touch of key (1) is modified by the variation of the point were the maximum repulsion effect acts in the travel of the key. As it is known, the repulsion effect is inversely proportional to the distance squared and the repulsion point position is maximal.

Figure 2A:
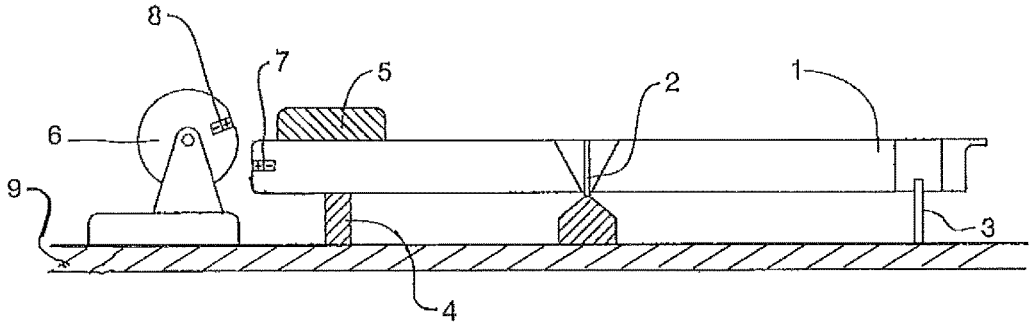
In FIG. 2*a* it is shown the key at rest position and in FIG. 2*b*, the key is shown completely pressed, illustrating the relationship between the two SM and KM magnets when the key is pressed and when the key is in rest position.
Figure 2B:
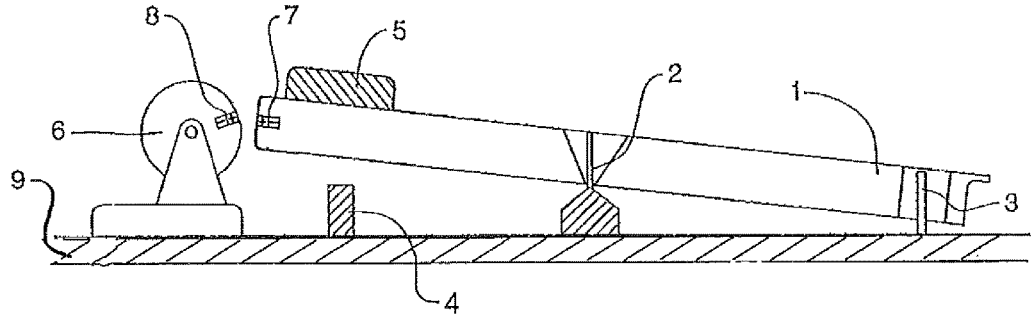
FIG. 2 shows the key of FIG. 1 with the set magnet (SM) affixed to the regulation device at an upper position in relation with the key magnet (KM).

In FIGS. 2*a* and 2*b* it is depicted a key (1) according to this invention, with the set magnet (SM) (8) attached to the regulation device (9) at an upper position with respect to the key magnet (KM). This configuration achieves an elastic, spring type effect, because the maximal repulsion point is located outside the travel zone of the key (1) and key magnet (KM).

The repulsion effect is maximal at the end of the travel of the key and minimal at the start, exactly as a spring would behave.

A maximal intensity is achieved when the maximal repulsion point is precisely at the end of the travel, and minimal when it lies outside the key (1) travel. In FIG. 2*a* it is depicted a key (1) at rest and in FIG. 2*b* it is depicted a key (1) completely pressed.

Figure 3A:
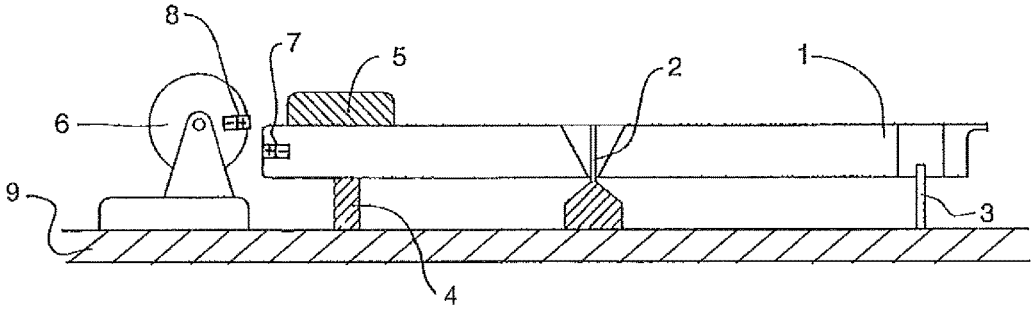
FIG. 3*a* shows the key at rest position.
Figure 3B:
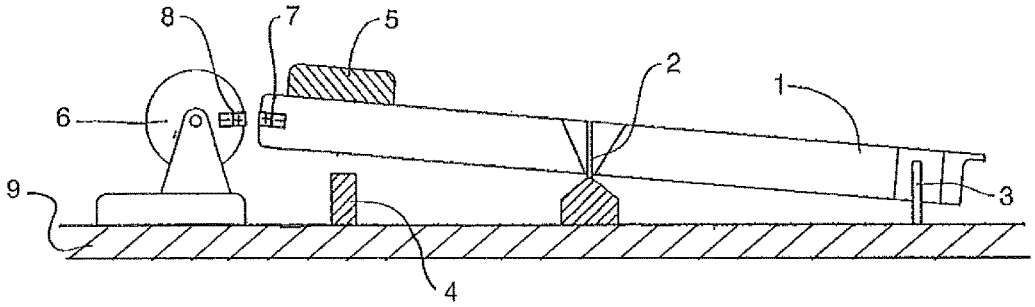
FIG. 3*b* shows the key at a middle position, at its point of maximum repulsion between the KM and the SM (escapement)
Figure 3C:
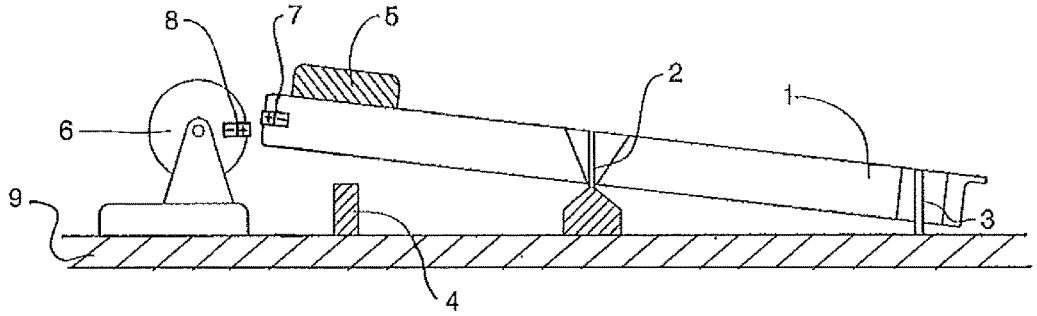
FIG. 3*c* shows the key after the escapement, completely pressed. Note the relationship between the two SM and KM magnets when the key is pressed and when the key is in rest position.

In FIGS. 3*a*, 3*b* and 3*c*, the regulation device (9) setting the set magnet (SM) (8) at the middle position is shown: This configuration achieves a weight effect and with escapement characteristic of a conventional piano.

In this configuration, the maximal repulsion point lies in the middle zone of the key (1) travel, because of which it an increase of the force necessary to press a key (1) downwards, which increases progressively (exponentially) until the maximal repulsion point is reached, and, beyond this point, it is generated a direction change of forces and a diminution of the force needed to press a key (1) up to the end of the travel (escapement effect). At the point of maximal repulsion, a small bump touch is sensed by the musician, because the repulsion effect behaves exponentially with respect to distance, and it is the utilization and handling of this effect what gives the escapement touch to the system.

The escapement point can be regulated with absolute freedom in any zone of the travel. FIG. 3*a* shows a key (1) at rest; FIG. 3*b* shows a key (1) at a middle position, at its maximal repulsion point between the KM and the SM (escapement), and FIG. 3*c* shows a key (1) after the escapement, completely pressed.

Figure 4A:
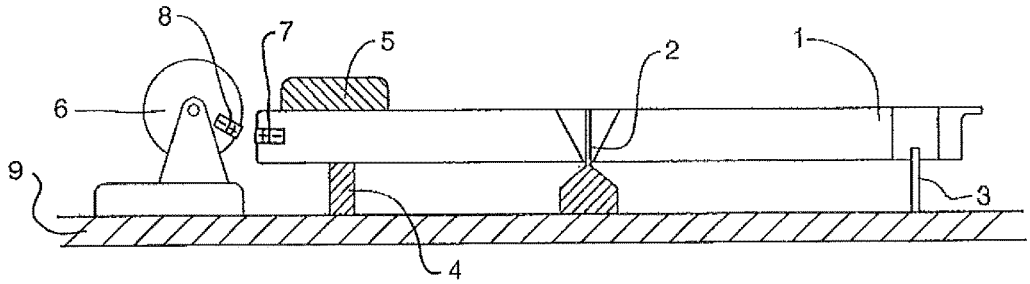
FIG. 4*a* shows the key at rest position.
Figure 4B:
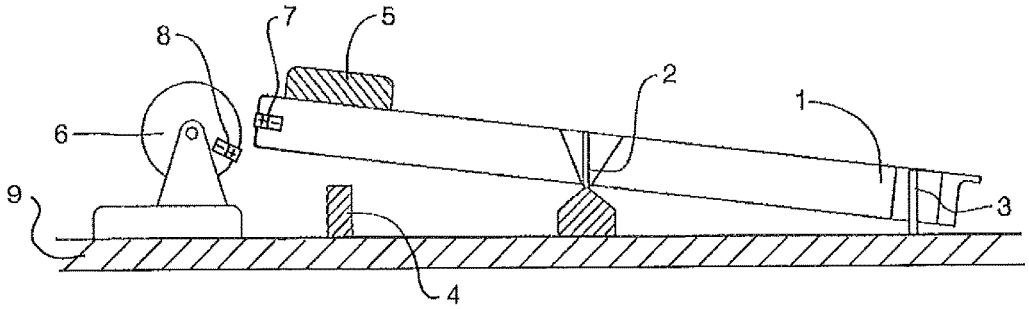
FIG. 4*b* shows the key at a position where it is completely pressed. Note the relationship between the two SM and KM magnets when the key is pressed and when the key is in rest position.

In FIGS. 4*a* and 4*b* it is seen the set magnet (SM) (8) attached to the regulation device (9), at a lower position respect to key magnet (KM). This configuration places the maximal repulsion point between the KM and the SM in the zone of travel commencement, because of which it simulates the release of organ valves.

The force needed to press a key (1) is maximal at the start of the travel, declining abruptly as soon as the pressure upon the key (1) commences.

The effect intensity is achieved by positioning the maximal repulsion point by setting the set magnet (SM) in any zone of travel start of the key magnet (KM) and it is minimal if this point lies outside below the key magnet (KM) (7) travel. FIG. 4*a* shows a key (1) at rest position and FIG. 4*b* shows a key (1) at full pressed position.

Through the modification of the distance between the two magnets, the SM and the KM (7, 8), a more or less pronounced effect is achieved, as well as through the modification of the shape and power of the magnets (SM and KM) (7, 8) or, even, through the use of electromagnets, what increases the electricity consumption by the apparatus; or the use of electro-permanent magnets, that use but an electric pulse for the regulation of the power, since they use electric energy during the change of state only.

The placement of secondary systems increases keyboard possibilities and versatility, but also complexity, weight and cost of the instrument comprising those systems, although it is functional when applying the same principles described.

Figure 5:
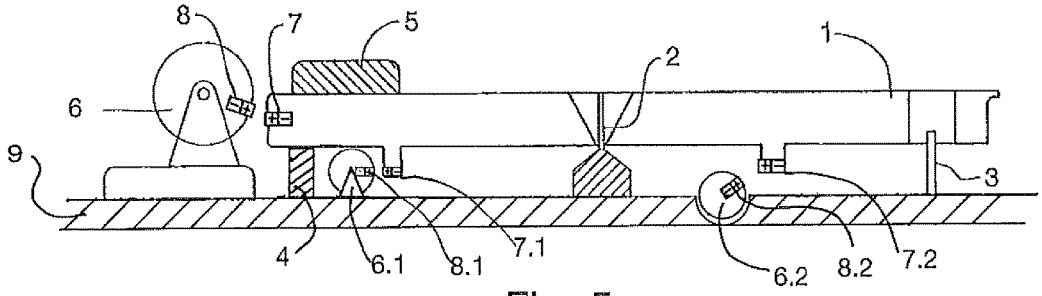
FIG. 5 shows a sectional lateral view of another form of a preferred embodiment of a key for a keyboard according to the present invention, with a central pivot point, a Hall sensor and comprising two additional systems, each one of which makes the primary system characteristics more powerful.

In FIG. 5 it is depicted an example of an alternative embodiment of a key (1) according to present invention, comprising two secondary systems (10, 11): each one of these systems is placed in a strategic way, to boost the characteristics of the primary systems, such as spring effect, escapement effect and weight, valve escapement and every intermediate point.

Figure 6:
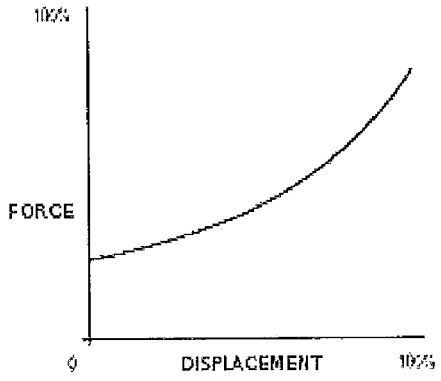
FIG. 6 shows a graph depicting a curve that illustrates the variation of the Force applied by a performer upon the key (ordinates) as a function of Displacement (abscissae), which characterizes the arrangement of the key with magnets set as shown in FIG. 2.

In FIG. 6 it is shown a graph where it is depicted a curve that illustrates the variation of the Force applied by the performer upon a key (1), on the ordinate, as a function of the Displacement, on the abscissa, corresponding to the response of the arrangement of a key (1) with magnets SM and KM (7, 8) set as that is depicted in FIG. 2.

Figure 7:
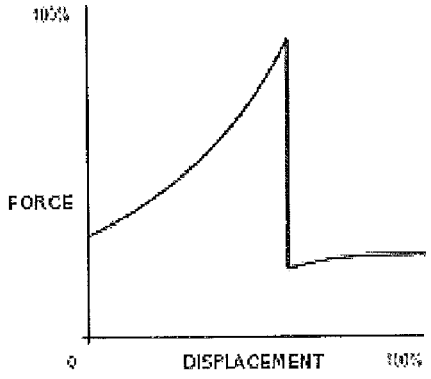
FIG. 7 shows a graph depicting a curve that illustrates the variation of the Force applied by a performer upon the key (ordinates) as a function of Displacement (abscissae), which characterizes the arrangement of keys with magnets set as shown in FIG. 3.

As regards FIG. 7 it can be seen a graph depicting a curve that illustrates the variation of the Force applied by the performer upon a key (1), on the ordinate, as a function of the Displacement, on the abscissa, that characterizes the arrangement of a key (1) with magnets SM and KM (7, 8) set as that is depicted on FIG. 3.

Figure 8:
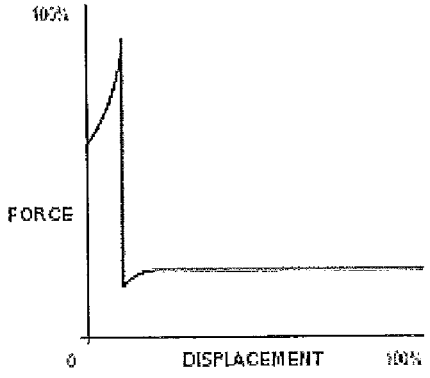
FIG. 8 shows a graph depicting a curve that illustrates the variation of the Force applied by a performer upon the key (ordinates) as a function of Displacement (abscissae), which characterizes the arrangement of keys with magnets set as shown in FIG. 4.

Besides, in FIG. 8 it is shown a graph where it is depicted a curve that illustrates the variation of the Force applied by the performer upon a key (1), on the ordinate, as a function of the Displacement, on the abscissa, corresponding to the arrangement of a key (1) with magnets SM and KM (7, 8) set as that is depicted on FIG. 4.

Figure 9A:
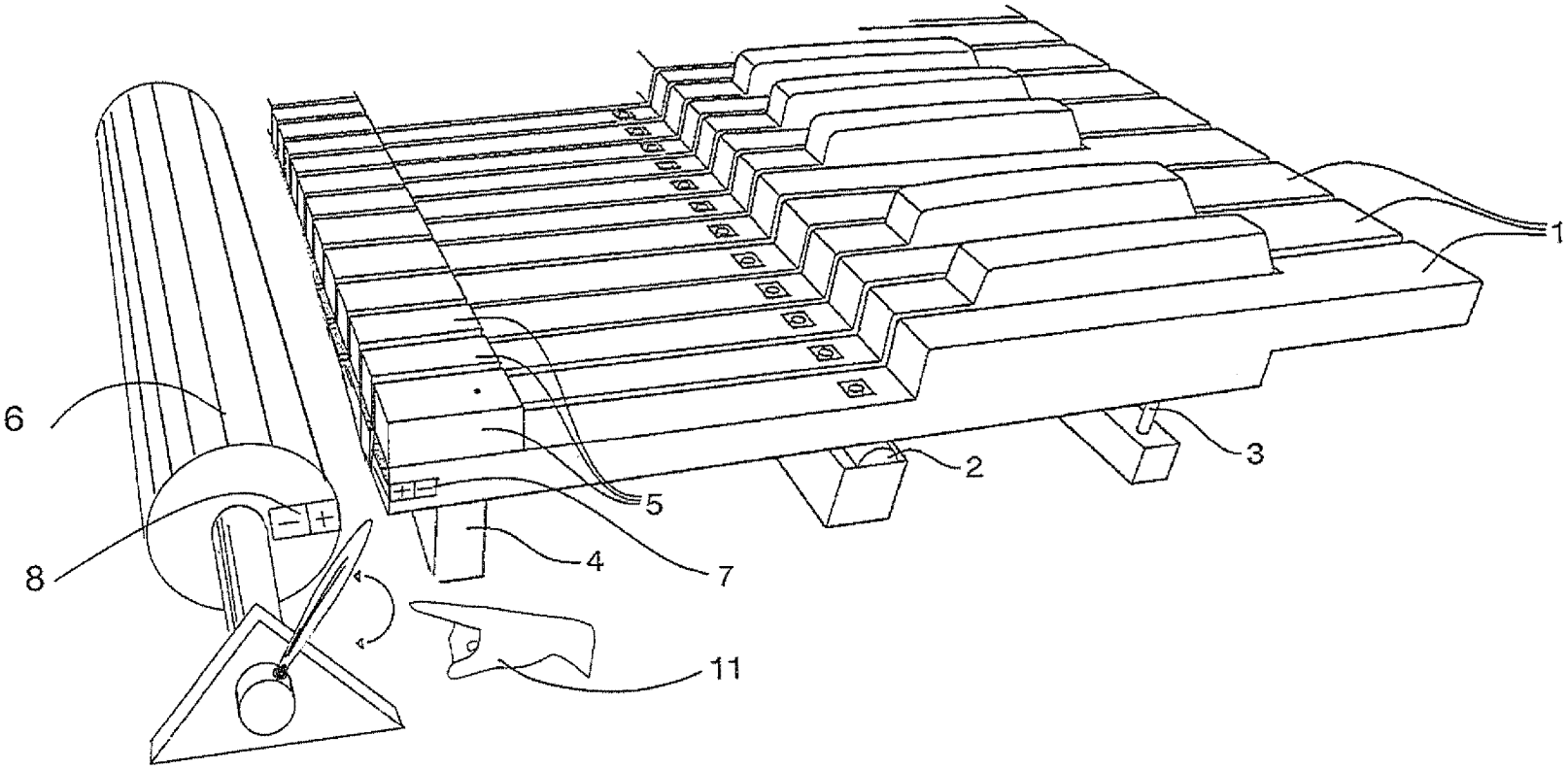
FIG. 9 shows a sector of a preferred embodiment of a keyboard according to the present invention, constituted by a plurality of keys according to FIG. 1.
Figure 9B:
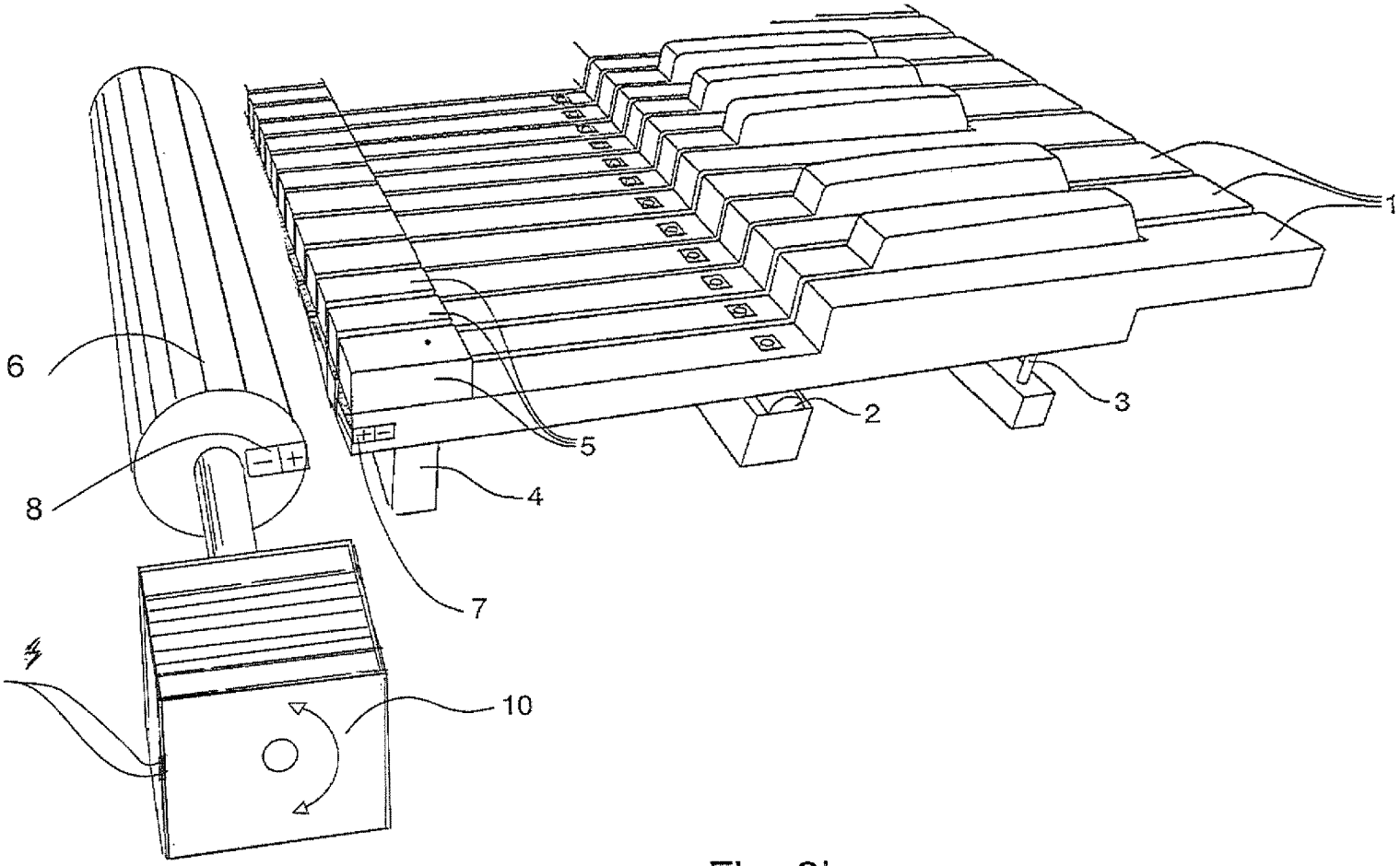

In particular, in FIG. 9 it is shown a sector of a preferred way of embodiment of a keyboard composed of a plurality of keys (1), according to any of the variations herein described above.

Figure 10:
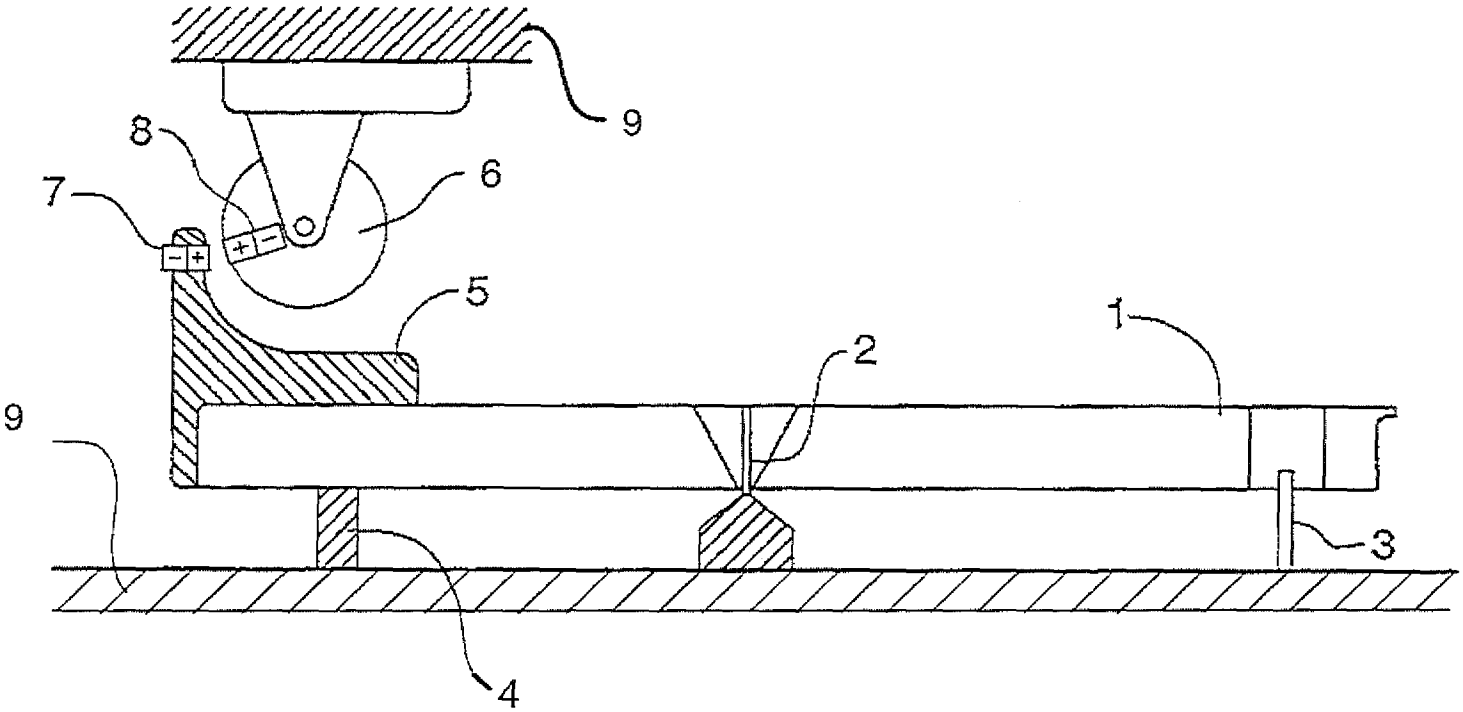
FIG. 10 shows a sectional lateral view of another preferred embodiment of a key for a keyboard according to the present invention, with the regulation device above the key instead of behind, but respecting the proposed operating mechanism.

Lastly, FIG. 10 shows a sectional lateral view of another preferred embodiment of a key (1) for a keyboard according to this invention, with a central pivot point (2) and a contactless position sensor (6), the embodiment comprising two magnets (KM and SM) (7, 8) affixed to the rear side of a key (1), and a regulation device respectively.

Therefore, the key magnet (KM) (7) is mounted on the counterweight (5) of a key (1), facing the set magnet (SM) (8) that is mounted on a regulation device (9) affixed to the instrument chassis, above the key (1), while the other magnet (7') is facing a contactless position sensor (6) that gives the location of the key; preferably, a Hall-type sensor.

What is being claimed is:

1. A keyboard with adjustable touch for a musical instrument, the keyboard comprising a plurality of keys, each key being a lever mounted on a pivot point substantially central that divides the lever into two arms, a front arm and a rear arm, where the front arm forms on its upper part an operation surface and its lower part interacts with a centering guide, and the rear arm comprises, on its upper part, a counterweight and its lower part interacts with a stop, wherein each key of the keyboard comprises a key magnet mounted on the rear arm, facing a set magnet attached to a regulation device that sets a position of said set magnet in relation with the key magnet, said regulation device being a primary system affixed to an apparatus chassis, being the key and set magnets always substantially faced by their equivalent polar faces, so said key and set magnets always repel each other, and a relative position of said key magnet and said set magnet generates the effect on the keyboard touch.

2. The keyboard according to claim 1, wherein the one set magnet is affixed to a regulation device that sets the position of said set magnet fixed thereon, and this regulation device being affixed to the apparatus chassis, while another different magnet is affixed to the rear arm of each key's rear arm.

3. The keyboard according to claim 2, wherein said regulation device, affixed to the apparatus chassis, comprises a support, where there is a series of set magnets arranged along the support, or a single set magnet constituted by a magnetic bar longitudinally mounted on said support or a plurality of supports with their respective set magnet independent for each key.

4. The keyboard according to claim 2, wherein said regulation device may take a series of movements that set the position of the set magnet, or magnets, mounted on said device, in relation with the key magnet, and define configuration touch modes of touch moving away or moving closer and/or from a lower position to an upper position, where the lower position is below a level of highest repulsion intensity of the magnetic field of the key's magnet, and the upper position is above the level of highest repulsion intensity of the magnetic field of key's magnet, where the keys and the keys magnet are in a rest position.

5. The keyboard according to claim 4, wherein said regulation device sets the configuration touch modes manually or through an electronically controlled motor by the user.

6. The keyboard according to claim 5, wherein the electronically controlled motor responds to instructions generated by a PLC, Programmable Logic Controller.

7. The keyboard according to claim 1, wherein each key comprises, accessorily, at least one secondary system arranged underneath the front arm or the rear arm, or underneath both front and rear arms at the same time, where the, at least one, secondary system comprises one pair of key and set magnets placed in opposition by their equivalent polar faces, the key magnet affixed to the back of the key part of the rear arm and the set magnet mounted on a different regulation device that is affixed to the apparatus chassis.

8. The keyboard according to claim 7, wherein each key comprises two secondary systems, one underneath the front arm and the other underneath the rear arm.

9. The keyboard according to claim 1, wherein the key magnets and the magnets mounted on the regulation device are selected from permanent magnets, electromagnets, electro-permanent magnets, and combinations thereof.

* * * * *